US007150218B2

(12) United States Patent
Berejnoi et al.

(10) Patent No.: US 7,150,218 B2
(45) Date of Patent: Dec. 19, 2006

(54) TARGET DEFENSE SYSTEM COMPRISING A PROJECTILE LAUNCHER DEVICE

(75) Inventors: Manuel Berejnoi, Paris (FR); Patrick Carassus, Vielle Adour (FR); Christian Jouret, Paris (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/519,716

(22) PCT Filed: Sep. 5, 2002

(86) PCT No.: PCT/FR02/03009

§ 371 (c)(1),
(2), (4) Date: Dec. 30, 2004

(87) PCT Pub. No.: WO2004/023058

PCT Pub. Date: Mar. 18, 2004

(65) Prior Publication Data

US 2005/0252368 A1 Nov. 17, 2005

(51) Int. Cl.
*F41A 23/54* (2006.01)
*F41A 23/24* (2006.01)

(52) U.S. Cl. ..... 89/37.22; 89/37.07; 89/37.13; 89/40.02

(58) Field of Classification Search ..... 89/36.08, 89/37.05, 37.07, 37.12, 37.13, 37.22, 40.02
See application file for complete search history.

(56) References Cited

U.S. PATENT DOCUMENTS

| | | | | |
|---|---|---|---|---|
| 478,899 | A * | 7/1892 | Whinfield et al. | 89/37.05 |
| 480,215 | A * | 8/1892 | Spiller | 89/37.05 |
| 2,382,225 | A * | 8/1945 | Hochstetler | 89/1.35 |
| 2,404,639 | A | 7/1946 | Lane | |
| 3,244,076 | A * | 4/1966 | Wey | 89/37.11 |
| 4,890,537 | A | 1/1990 | Streit et al. | 89/37.11 |

FOREIGN PATENT DOCUMENTS

| | | |
|---|---|---|
| DE | 19 32 991 | 1/1971 |
| EP | 1 096 218 A2 | 5/2001 |
| FR | 2 704 050 | 10/1994 |
| FR | 2 722 873 | 1/1996 |
| FR | 100 50 479 A | 4/2002 |
| WO | WO 01/88564 A1 | 11/2001 |

* cited by examiner

*Primary Examiner*—Stephen M. Johnson
(74) *Attorney, Agent, or Firm*—Steptoe & Johnson LLP

(57) ABSTRACT

The invention relates to a defense system for a target against an attacking projectile of the type incorporating a launcher for defensive projectiles and control means for the device after the attacking projectile has been detected, wherein the launcher device comprises a cupola mobile in bearing with respect to the target and a launcher integral with the cupola and articulated in elevation in the bearing range of the cupola to ensure the compactness of the whole assembly with respect to the target.

10 Claims, 3 Drawing Sheets

TARGET DEFENSE SYSTEM COMPRISING A PROJECTILE LAUNCHER DEVICE

BACKGROUND OF THE INVENTION

1. Field of the Invention

The technical scope of the present invention is that of protection devices for a target attacked by a projectile.

2. Description of the Related Art

To protect a target, such as an armored vehicle, a shelter or building, it is known to provide means enabling an attacking projectile to be spotted and a defensive projectile to be fired in retaliation to destroy, deviate and/or perturb the attacking projectile before it reaches said target. The attacking projectile is very often a missile, but may be any of other type, for example a discarding-sabot projectile, a shaped or hollow charge projectile, etc. . . .

Thus, patent FR-A-2 722 873 describes a protection system comprising a launcher container, mobile in elevation and in bearing, servo controlled by a detection system allowing the firing of a defensive projectile to be triggered from the container. In this patent, a defensive projectile constituted by a splinter grenade is proposed.

A system is also known described by U.S. Pat. No. 5,036,748 comprising a cupola mobile in bearing with respect to an armored vehicle and supporting two launcher tubes mobile in elevation. A radar system enables the attacking missile to be spotted and the launch of an anti-missile defensive projectile to be triggered.

Patent DE-3 410 467 also proposes a defensive projectile constituted by a splinter-forming charge designed to perturb the attacking missile.

U.S. Pat. Nos. 5,229,540, 4,765,244 and FR-2458044 describe defense systems against attacking missiles that consist of the launch of a defensive projectile against such missiles.

In all the proposed systems, classical means are used to ensure orientation in elevation and in bearing, analogous to those implemented to orient a cannon or launcher. As a reminder, we note that the cannon is mobile in elevation with respect to a turret or support and that this turret is mobile in bearing with respect to the target. This architecture is well known to orient the cannon in all directions.

The drawback of these systems lies in the fact that they cause a modification of the silhouette of the target making it easier for the attacker to detect and thus more visible and more vulnerable.

SUMMARY OF THE INVENTION

The aim of the present invention is to supply a defense system integrated into a target to be protected and which gives the latter a more compact appearance.

The invention thus relates to a defense system for a target against an attacking projectile of the type incorporating a launcher device for defensive projectiles and control means for the device after the attacking projectile has been detected, wherein the launcher device comprises a cupola mobile in bearing with respect to the target and a launcher integral with the cupola and articulated in elevation in the bearing range of the cupola to ensure the compactness of the whole assembly with respect to the target.

According to one characteristic of the invention, the launcher is mounted articulated at its base around a hinge pin integral with the cupola.

According to another characteristic of the invention, the cupola is in the form of a circular seat delimiting a lateral wall whose height is less than half its external diameter.

According to yet another characteristic of the invention, the launcher is activated in elevation by a jack placed in the inner space delimited by the lateral wall, integral at one end with the cupola and whose rod is integral with a lever extending the base of said launcher.

According to another characteristic of the invention, at zero elevation jack rod is parallel to the plane (P1) of rotation in bearing of the cupola.

Advantageously, the launcher is articulated in elevation according to an angle of between −10° and +70°.

Advantageously again, the length of the launcher is substantially equal to the diameter (d) of the cupola.

Advantageously again, the launcher incorporates at least two launcher tubes placed side by side.

Advantageously again, the cupola is activated in bearing rotation with respect to the target using a rack pinion assembly, the pinion being integral with the cupola.

Advantageously again, the rack is integral with the control means comprising a double-acting jack whose piston is activated by a hydraulic unit.

Advantageously again, the axis of the piston is substantially parallel to the plane of bearing rotation.

A first advantage of the system according to the invention lies in the fact that the cupola and the launcher form a single unit integratable in any type of target.

Another advantage lies in the fact that the outer dimensions of the single unit are compatible with the environment of a combat tank.

Another advantage lies in the fact that a target may be equipped with several systems according to the invention.

BRIEF DESCRIPTION OF THE DRAWINGS

Other characteristics, particulars and advantages of the invention will become more apparent from the following description given by way of illustration and in reference to the drawings, in which.

DETAILED DESCRIPTION OF PREFERRED EMBODIMENTS

Figure 1:
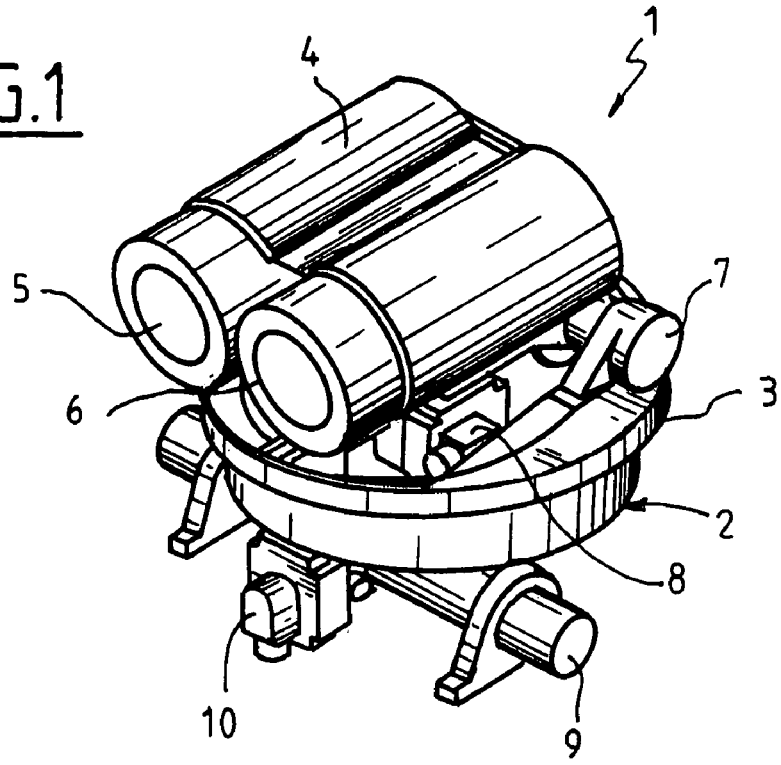
FIG. 1 is a general view of the launcher device.

FIG. 1 shows a general view of the launcher device 1 according to the invention, the control means after the detection of an attacking projectile not being shown. Indeed, this system is known in itself and may be constituted by an embodiment such as those divulged by the previously mentioned patents. A preferred application of the invention consists in equipping a combat tank with one or several fixed cupolas either on the chassis or on the turret.

The device such as shown in this Figure may be integrated onto any target requiring protection by providing a ring equipped with a bearing. It comprises a cupola 2 in the form of a seat 3 having circular symmetry whose lateral cylindrical wall only may be seen. This seat 3 is generally flattened in shape and its height is reduced with respect to its diameter so as to delimit a receptacle intended to receive the elevation control means. By way of illustration, the height of the seat may be less than its radius. This seat receives, on its upper side, a launcher 4 comprising two defensive projectile launch tubes 5 and 6 connected together. Tubes 5 and 6 are oriented in the same direction, that is to say their firing axes are parallel. The launcher 4 is articulated in elevation with respect to the seat 3 around trunnions 7 whose ends are fixed along a secant. There is the hydraulic unit 8 located in the receptacle under the launcher 4 that controls its elevation rotation.

Under the seat 2, control means 9 ensure the bearing rotation of this seat with respect to the target in relation with the hydraulic unit 10.

Naturally, the cupola 2 may be equipped with a greater number of tubes, for example 3 to 6. It is preferable for the firing axes of these tubes to be parallel to each other so as to keep the compactness of the assembly. Thus, if three tubes are provided the three firing axes will be in the same plane.

Figure 2:
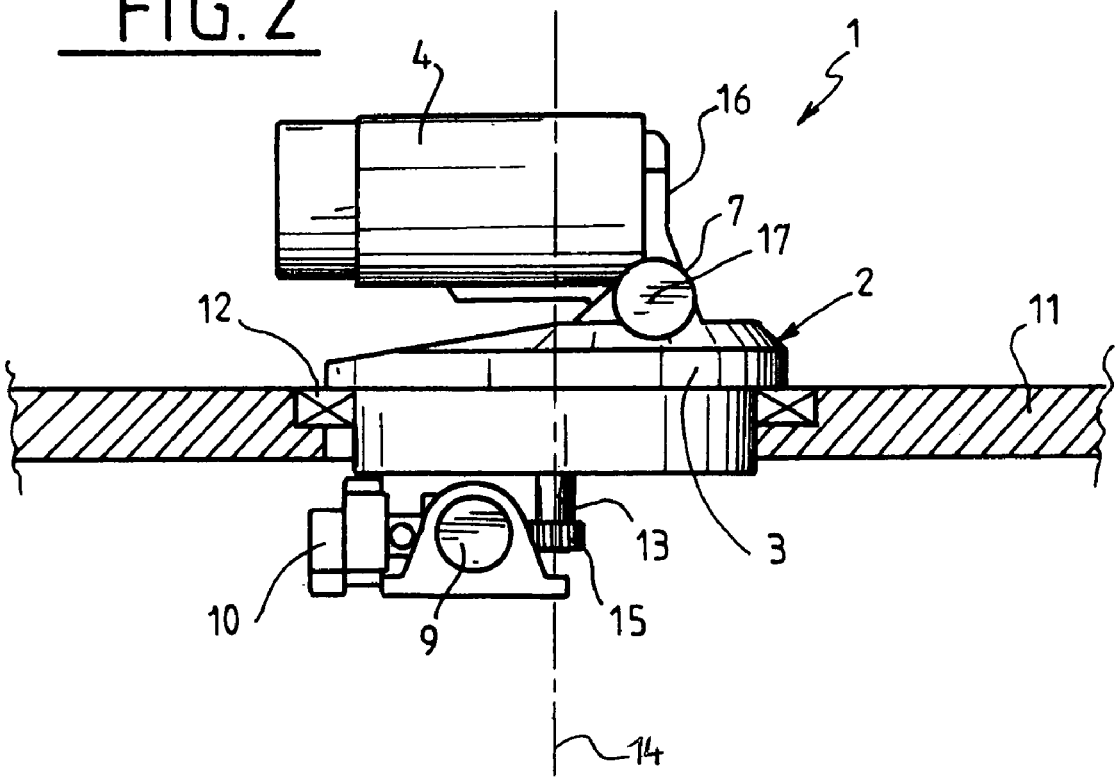
FIG. 2 is a side view of the launcher positioned on its support.

FIG. 2 shows a view of the device 1 placed on a support 11 that is part of the target. The cupola 2 is mounted able to rotate with respect to the support 11 by means of a bearing 12. To ensure the bearing rotation of the cupola, it is fitted with a shaft 13 aligned along the axis 14 of the bearing 12. The shaft 13 is provided with a pinion 15 cooperating with the control means 9. As may be seen in this Figure, the launcher 4 is provided at its bottom wall 16 with reception means for the trunnions 7 to ensure a rotation around the hinge pin 17. This hinge pin 17 is located below and outside of the launcher. This arrangement ensures the elevation rotation of the launcher in the bearing rotation of the cupola.

Figure 3:
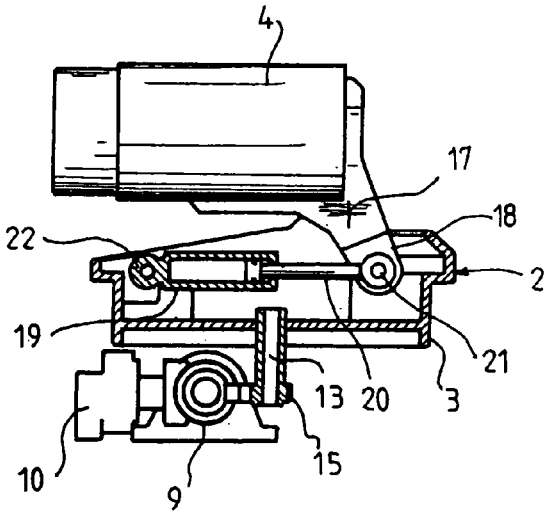
FIG. 3 is a vertical section of the cupola showing the elevation and bearing rotation means.

FIG. 3 represents a section of the elevation and bearing control means for the device. The launcher 4 is fitted with a lever 18 fixed at its base and whose free end extends beyond the hinge pin 17. To orient the launcher 4 in elevation, the seat 3 is provided in its receptacle with a jack 19 whose rod 20 is fixed at the free end 21 of the lever 18 and whose body is fixed by a joint 22 to the seat. The jack 19 is in relation with the hydraulic unit 8 to ensure its functioning. Under the seat 3, the hydraulic unit 10 in relation with the control means 9 ensures the bearing rotation of the cupola.

Figure 4:
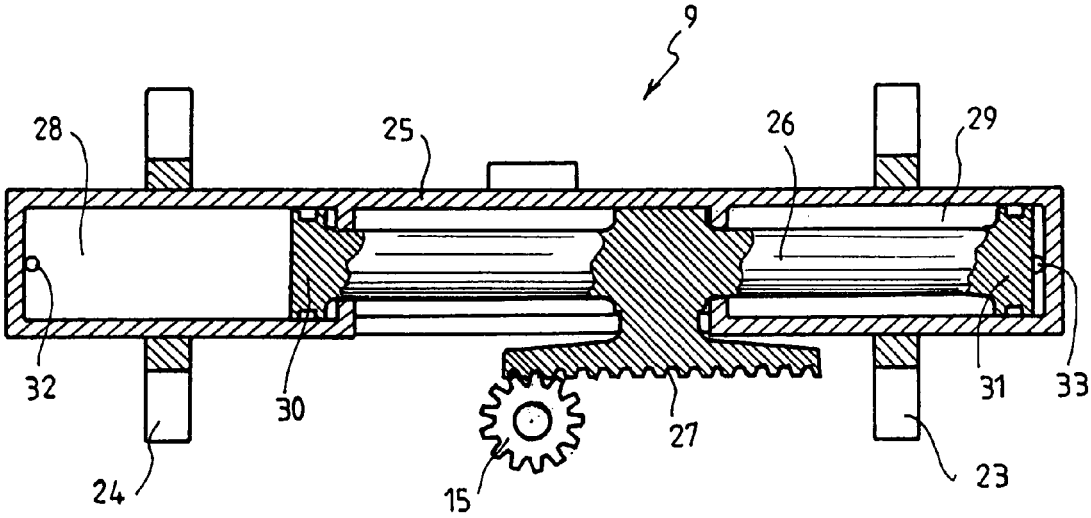
FIG. 4 shows the cupola's bearing drive means.

FIG. 4 illustrates the embodiment of the control means 9 which are fixed rigidly to the target by two fork joints 23 and 24. These means are in fact a double-acting jack whose body 25 receives a rod 26 which supports a rack 27 meshed with the pinion 15. This body delimits two lateral chambers 28 and 29 in which the ends of the rod form pistons 30 and 31 whose sealing in the respective chambers 28 and 29 is ensured in a classical manner. A free space is provided between chambers 28 and 29 intended for the clearance of the rack 27. Chambers 28 and 29 are respectively supplied with fluid via orifices 32 and 33 by the hydraulic unit 10. The Figure shows the rod 27 on the right which means that the chamber 29 has emptied by orifice 33 whereas chamber 28 has filled by orifice 32. Thus, the rack 27 is activated in translation following a to and fro motion activating the filling of one or other of the two chamber to drive the pinion 15 in rotation and thus drive the cupola in bearing rotation. Naturally, the rack 27 may occupy all the intermediate positions so as to drive cupola in bearing according to the position required by the user.

Figure 5:
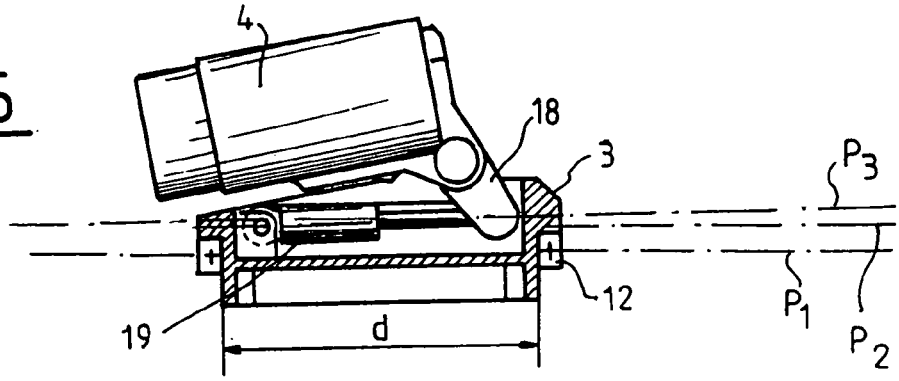
FIGS. 5 to 7 show the positions of the launcher at negative, zero and positive elevations.
Figure 6:
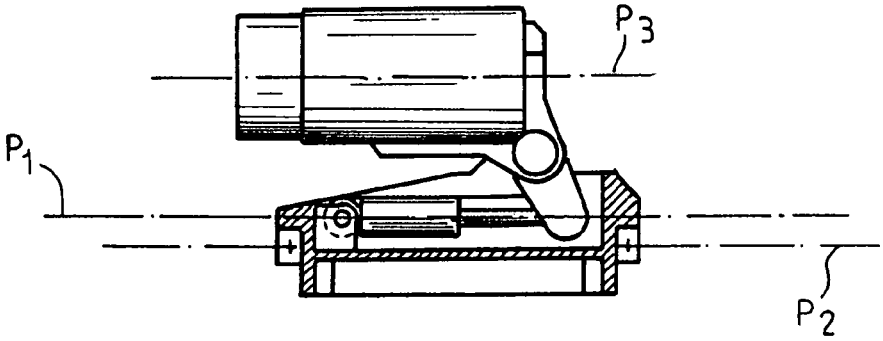
Figure 7:
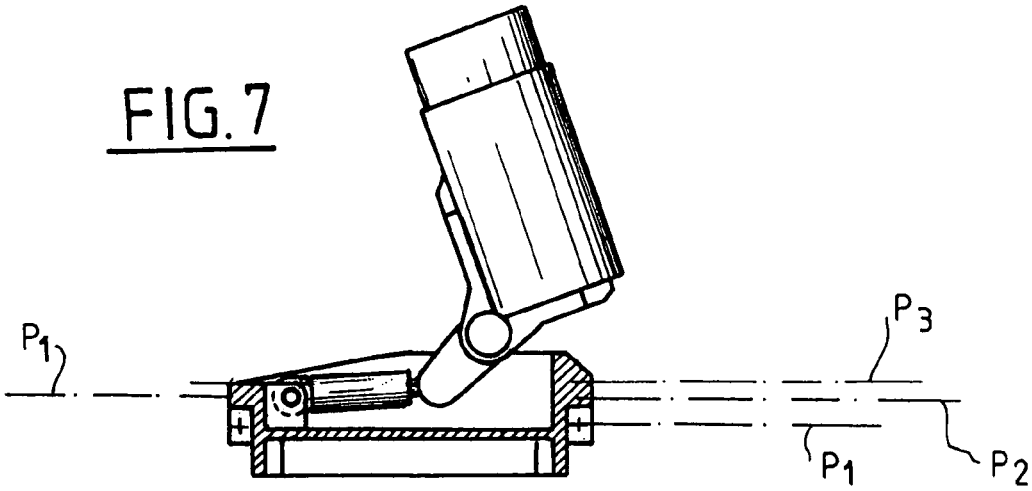

FIGS. 5 to 7 show three positions of the launcher 4 in elevation further to the activation of the cylinder 19.

FIG. 5 shows the maximal negative elevation of around −10°. The lever 18 can be seen to be pushed near to the inner lateral wall of the seat 3 and the rod of the jack 19 is in its position of maximal extension. That is P1 the bearing plane, P2 the parallel plane to P1 through the hinge point of the lever. If P3 is defined as the plane parallel to P1 through the hinge point of the lever 18 parallel to plane P1, the end of the cylinder rod is thus above plane P2 near to bearing plane P1. The distance separating these two planes P3 and P2 is of around 1 to 2% of the seat's diameter.

FIG. 6 shows the launcher 4 at zero elevation where plane P2 is the same as plane P3. The jack 19 is thus in plane P2.

FIG. 7 shows the maximal elevation of around +70°, the jack rod 19 being totally retracted and above plane P2. The distance separating the two planes P2 and P3 is of around 4 to 5% of the seat's diameter.

Thus, a minimal variation in position of the jack 19 allows a satisfactory variation in elevation of the launcher 4. It is this arrangement in the bearing which satisfactorily ensures the compactness of the whole structure. This compactness is important in that it means that the silhouette of the target need not be greatly modified especially where the target is an armored combat vehicle.

What is claimed is:

1. A defense system, comprising:

a cupola having a circular seat for rotating about a central axis, said circular seat having a lateral wall whose height is less than half its external diameter;

a launcher comprising at least two projectile launch tubes, said projectile launch tubes being aligned parallel to each other, said projectile launch tubes each having a length substantially equal to the diameter of said circular seat, said projectile launch tubes being positioned next to each other, an end of said launcher being pivotally attached to said cupola, wherein said launcher is articulated in elevation with respect to said circular seat around trunnions whose ends are fixed along a secant of said circular seat; and a hydraulic unit located under said launcher and attached to said circular seat, said hydraulic unit for controlling the elevation of the launcher with respect to said circular seat.

2. The defense system according to claim 1, further comprising a hinge pin integral to said cupola to which said launcher is pivotally attached.

3. The defense system according to claim 2, wherein said hydraulic unit comprises a jack and a jack rod, said jack attached to said circular seat and said rod attached to said launcher.

4. The defense system according to claim 3, further comprising a lever having two ends, said lever attached at one end to the rear part of said launcher, the other end of said lever attached to said rod, said lever being pivotally attached to said hinge pin between the two ends of said lever.

5. The defense system according to claim 4, wherein said launcher may be elevated 10 degrees below horizontal and 70 degrees above horizontal.

6. The defense system according to claim 3, wherein said jack rod is parallel to a plane of rotation of said cupola when said launcher is at zero elevation.

7. The defense system according to claim 1, wherein said cupola is rotated with a rack and pinion assembly.

8. The defense system of claim 7, wherein said pinion is integral with said cupola.

9. The defense system of claim 8, wherein said rack is attached to a double-acting jack whose piston is activated by a second hydraulic unit.

10. The defense system according to claim 9, wherein said piston is substantially parallel to said cupola's plane of rotation.

* * * * *